US006385421B1

(12) United States Patent
Imamiya et al.

(10) Patent No.: US 6,385,421 B1
(45) Date of Patent: May 7, 2002

(54) IMAGE FORMING APPARATUS INCLUDING A RETURNING MECHANISM FOR RETURNING EXCESSIVE DEVELOPING LIQUID

(75) Inventors: Koji Imamiya; Yuka Yamaguchi, both of Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/649,994

(22) Filed: Aug. 29, 2000

(30) Foreign Application Priority Data

Sep. 21, 1999 (JP) ..... 11-266950

(51) Int. Cl.[7] ..... G03G 15/10
(52) U.S. Cl. ..... 399/237; 399/238; 399/249
(58) Field of Search ..... 399/237, 238, 399/249

(56) References Cited

U.S. PATENT DOCUMENTS 3,650,196 A * 3/1972 Hosoe et al. ..... 399/237 X
4,102,306 A * 7/1978 Ohta ..... 399/237 X
4,181,094 A * 1/1980 Gardiner ..... 399/249
5,576,815 A 11/1996 Teschendorf et al. ..... 355/256
5,642,188 A * 6/1997 Mochizuki et al. ..... 399/237
5,933,689 A * 8/1999 Kim ..... 399/237 X
6,104,901 A * 8/2000 Imamiya ..... 399/249

* cited by examiner

*Primary Examiner*—Fred L. Braun
(74) *Attorney, Agent, or Firm*—Foley & Lardner

(57) ABSTRACT

An image forming apparatus includes a latent image forming mechanism for forming an electrostatic latent image on a photosensitive member, and a developing device for supplying a developing liquid containing at least toner and a carrier liquid, to the photosensitive member on which the latent image is formed, thereby to develop the latent image. The image forming apparatus also includes a removing device for removing an excessive portion of the developing liquid supplied by the developing device, whereby the excessive portion of the developing liquid remains on the photosensitive member after development. The image forming apparatus further includes a returning mechanism for returning the excessive portion of the developing liquid, which is removed by the removing device, into a casing of a developing liquid supply unit for supplying the developing liquid to the developing device, and a reserve flow-in section. The reserve flow-in section has a float and is provided in front of a developing liquid container section in the casing of the developing liquid supply unit, thereby to return the developing liquid to the reserve flow-in section when the valve is opened.

14 Claims, 10 Drawing Sheets

IMAGE FORMING APPARATUS INCLUDING A RETURNING MECHANISM FOR RETURNING EXCESSIVE DEVELOPING LIQUID

CROSS-REFERENCE TO RELATED APPLICATIONS

This application is based upon and claims the benefit of priority from the prior Japanese Patent Application No. 11-266950, filed Sep. 21, 1999, the entire contents of which are incorporated herein by reference.

BACKGROUND OF THE INVENTION

The present invention relates to an image forming apparatus and particularly to an image forming apparatus which forms an image by a wet developing method with use of a liquid developer in which toner is dispersed in a solvent.

An image forming apparatus using a liquid developer attracts attention again as a technique which matches with high speed and high image quality and can provide an image with high image quality owing to toner of fine grains. This apparatus is excellent in gradient reproductivity and can provide an image equal to printing. The softening point of the toner is low and an advantage is obtained in that images can be easily fixed. However, since the developer is a liquid composed of toner grains and a carrier liquid, further improvements are required for the supply method thereof and the method of removing an excessive developing liquid (carrier liquid) remaining on a photosensitive member. In the present situation, a satisfactory image forming apparatus has not yet been obtained with respect to the developing device, transfer device, and cleaning devices for respective parts.

U.S. Pat. No. 5,576,815 discloses a wet electrophotographic color image forming apparatus.

FIG. 11 is a view schematically showing the wet electrophotographic color image forming apparatus described in an embodiment of the above-mentioned patent.

In the patent according to the invention in the patent, there is a description that the image forming apparatus includes "a plurality of developing sections 12, 14, 16, and 18 arranged along a route of a photosensitive member, and in FIG. 11, the system 10 is constructed so that a multi-color image can be formed by one single path of a photosensitive member 20 provided therein. If this kind of single bus system 10 is adopted, a multi-color image can be formed at a very high speed."

Also, the patent describes that "the image forming apparatus according to the above-described invention can be applied to a single-color liquid developing system and a multi-color/multi-path liquid developing system, although the image system 10 is shown as a multi-color/single-path step in FIG. 11."

Further, there is a description saying the "applicability to a system in which the photosensitive member is a belt, drum, or sheet-like one". However, the embodiment only shows a belt-like photosensitive member but does not at all describe merits obtained in case where the photosensitive member has a drum-like shape. It does not describe originality or inventivity which should be required because the photosensitive member is a drum-like member, or improvements thereof. Thus, the patent merely suggests possibility of a drum-like photosensitive member.

Actually, in case of a drum-like photosensitive member, further originality, inventivity, and improvements are required.

On the other hand, the present invention provides a wet electrophotographic color image forming apparatus which realizes a multi-color/single-path step in case of using a drum-like photosensitive member (including a drum with a sheet wound thereon) and provides a wet electrophotographic color image forming apparatus which overcomes all the conventional problems.

BRIEF SUMMARY OF THE INVENTION

The present invention has an object of providing a color image forming apparatus according a liquid developing method and a developing liquid supply unit, which uses a drum-like photosensitive member and are capable of forming multi-color images at a high speed.

The present invention has been made on the basis of the problems described above and provides a developing liquid supply unit which has a casing for containing a developing liquid and is detachably attached to an image forming apparatus, comprising: a driven member for receiving a drive force from outside; a discharging section for discharging the developing liquid from the casing to the outside; a receiving section for receiving the developing liquid from the outside into the casing; and a developing liquid transfer mechanism for supplying the developing liquid in the casing, to a developing device in the image forming apparatus, through the discharging section, based on the drive force to the driven section, and for further returning the developing liquid from the developing device into the casing through the receiving section, in a situation that the developing liquid transfer mechanism is attached to the image forming apparatus.

Also, the present invention provides an image forming apparatus comprising: a latent image forming mechanism for forming an electrostatic latent image on a photosensitive member; a developing device for supplying a developing liquid containing at least toner and a carrier liquid, to the photosensitive member on which the latent image is formed, thereby to develop the latent image; a removing device for removing an excessive portion of the developing liquid supplied by the developing device, the excessive portion of the developing liquid remaining on the photosensitive member after development; and a returning mechanism for returning the excessive portion of the developing liquid, which is removed by the removing device, into a casing of a developing liquid supply unit for supplying the developing liquid to the developing device.

Also, the present invention provides an image forming apparatus comprising: a plurality of latent image forming devices provided along an arc-like surface of a photosensitive member, for forming an electrostatic latent image on the surface of the photosensitive member; and a plurality of developing mechanisms for supplying a developing liquid containing at least toner and a carrier liquid, to the photosensitive member on which the latent image is formed, thereby to develop the latent image, wherein the latent image forming devices includes a plurality of light sources each has a laser device, a single deflection device for deflecting a plurality of beams respectively generated from the laser sources, and an imaging lens for providing the plurality of beams deflected by the deflection device with a predetermined characteristic, thereby to form an image on the photosensitive member.

Also, the present invention provides an image forming apparatus comprising: a plurality of latent image forming devices provided along an arc-like surface of a photosensitive member, for forming an electrostatic latent image on the surface of the photosensitive member; a plurality of developing mechanisms provided along the arc-like surface of the photosensitive member, for supplying a developing liquid containing at least toner and a carrier liquid, to the photosensitive member on which the latent image is formed, thereby to develop the latent image; and a plurality of hold member for holding the developing mechanisms such that lowermost parts of developing rollers, levels of the developing liquid, and end parts of openings are arranged in this order from a lower side in a gravitational direction, respectively.

Also, the present invention provides an image forming apparatus comprising: a plurality of charging device provided along an arc-like surface of a photosensitive member, for charging the surface of the photosensitive member; a plurality of latent image forming mechanisms for forming electrostatic latent images on the surface of the photosensitive member charged by the charging device, respectively; and a plurality of developing devices for supplying a developing liquid containing at least toner and a carrier liquid, to the photosensitive member on which the latent images are formed by the latent image forming mechanisms, thereby to develop the latent images, respectively.

Also, the present invention provides an image forming apparatus comprising: a plurality of latent image forming mechanisms provided along an arc-like surface of a photosensitive member, for forming at least one electrostatic latent image on the surface of the photosensitive member; a plurality of developing devices for supplying a developing liquid containing at least toner and a carrier liquid, to the electrostatic latent image formed on the surface of the photosensitive member, thereby to develop the latent images; and a plurality of developing liquid removing mechanisms respectively provided for the developing devices, for removing an excessive portion of the developing liquid from the surface of the photosensitive member supplied with the developing liquid.

Also, the present invention provides an image forming apparatus comprising: a latent image forming mechanism for forming an electrostatic latent image on a photosensitive member; a developing device for supplying a developing liquid containing at least toner and a carrier liquid, to the photosensitive member on which the latent image is formed by the latent image forming mechanism, thereby to develop the latent image; and a removing device for removing an excessive portion of the developing liquid supplied to the photosensitive member by the developing device, the excessive portion of the developing liquid being on the photosensitive member, wherein the removing device includes a nozzle having a top end provided near the surface of the photosensitive member, and having a through-hole, a suction device for suctioning the developing liquid through the through-hole of the nozzle, and a positioning mechanism for setting a predetermined distance between the top end of the nozzle and the photosensitive member.

Also, the present invention provides an image forming apparatus comprising: a latent image forming mechanism for forming an electrostatic latent image on a photosensitive member; a developing device for supplying a developing liquid containing at least toner and a carrier liquid, to the photosensitive member on which the latent image is formed by the latent image forming mechanism, thereby to develop the latent image; and a removing device for removing an excessive portion of the developing liquid supplied to the photosensitive member by the developing device, the excessive portion of the developing liquid being on the photosensitive member, wherein the removing device includes a suction device for suctioning air, a pipe member for connecting the suction device with the suction nozzle near the photosensitive member, and a filter member provided in a middle of the pipe member, for separating the carrier liquid from the air suctioned.

Also, the present invention provides an image forming apparatus comprising: a photosensitive member; and a wet color image forming unit of an integrated type including a plurality of developing rollers, a plurality of removing devices for removing an excessive portion of a developing liquid on the photosensitive member, and a plurality of windows for passing a light beam from an exposure device, for forming an electrostatic latent image on the photosensitive member.

Also, the present invention provides an image forming apparatus comprising: a latent image forming mechanism for forming an electrostatic latent image on a photosensitive member; a developing device for developing the electrostatic latent image by supplying a developing liquid containing at least toner and a carrier liquid, to the photosensitive member on which the electrostatic latent image is formed by the latent image forming mechanism, thereby to form a toner image; an offset roller provided in contact with the photosensitive member and rotated in synchronization with rotation of the photosensitive member, so that the toner image formed by the developing device is transferred onto the offset roller; and a cleaning mechanism for removing the toner from the offset roller, wherein during cleaning, the offset roller is rotated by one turn or more in contact with the offset roller.

Also, the present invention provides an image forming apparatus comprising: a latent image forming mechanism for forming an electrostatic latent image on a photosensitive member; a developing device for supplying a developing liquid containing at least toner and a carrier liquid, to the photosensitive member on which the latent image is formed by the latent image forming mechanism, thereby to develop the electrostatic latent image; a removing device for removing an excessive portion of the developing liquid supplied by the developing device, the excessive portion of the developing liquid remaining on the photosensitive member; and a developing liquid collecting mechanism connected with the developing liquid removing device, for collecting the developing liquid by suctioning the liquid, wherein an exhaust gas generated by the developing liquid collecting mechanism is circulated inside the image forming apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be explained on the basis of the drawings. However, the present invention is not limited to those embodiments.

Figure 1:
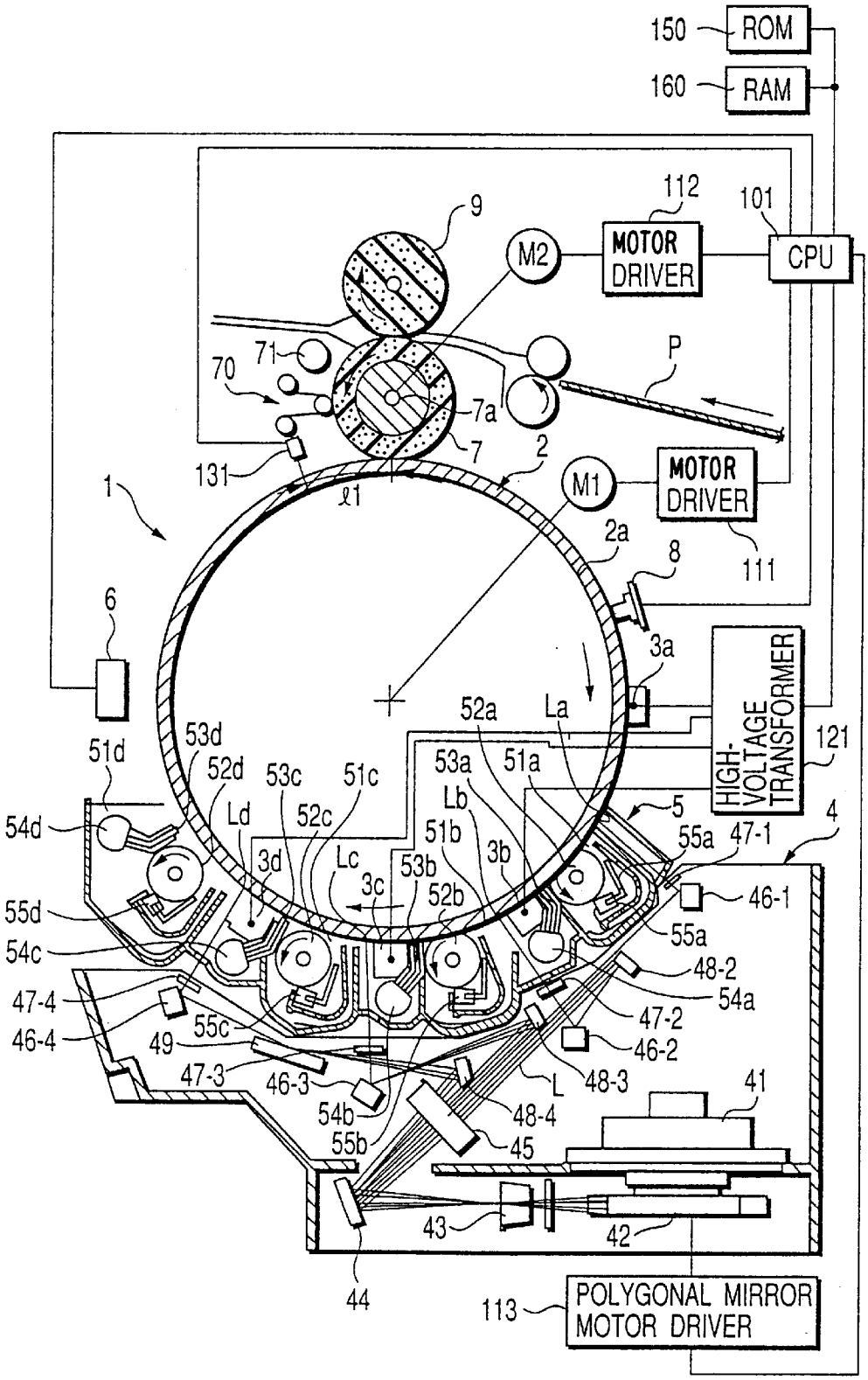
FIG. 1 is a schematic view showing an example of a color image forming apparatus to which a liquid developing device as an embodiment of the present invention is applied.

FIG. 1 is a schematic view showing an example of the image forming apparatus having a developing device to which a squeeze mechanism is applied as an embodiment of the present invention.

As shown in FIG. 1, a discharge LED 8, a charger 3*a,* an image forming section 5, a sensor 6, and an offset roller 7 including an offset roller heater 7*a* are arranged around a photosensitive drum 2 which rotates in the arrow direction, along the rotating direction thereof, in the image forming apparatus 1 according to the present invention. Provided in the image forming section 5 are a latent image forming means 4, developing devices 51*a,* 51*b,* 51*c,* and 51*d* comprising developing rollers 52*a,* 52*b,* 52*c,* and 52*d,* squeeze nozzles 53*a,* 53*b,* 53*c,* and 53*d* for suctioning and removing an excessive liquid developer on the photosensitive drum 2. Electrification chargers 3*b* to 3*d* are provided in front of the developing rollers 52*b,*52*c,* and 52*d* in the second and later stages.

The electrification chargers 3*a* to 3*d* are connected to a high-voltage power source (transformer) 121, and electrification timings are controlled by a CPU 101. Although not clearly shown in the figure, each developing device is equipped with a developing liquid supply unit for supplying developing liquids of respective colors (of Yellow (Y), Cyan (C), Magenta (M), and Black (B) in this case).

Figure 2:
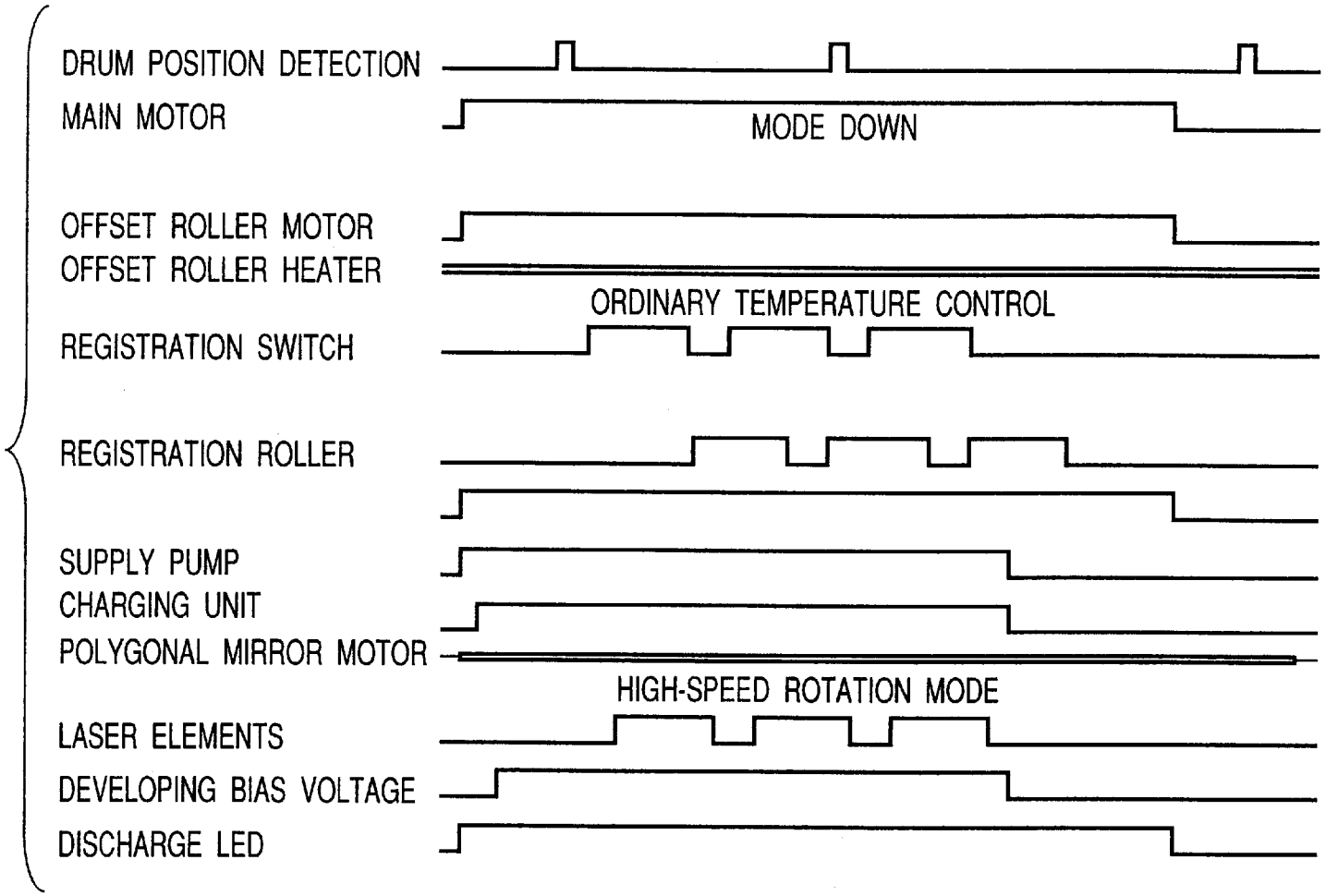
FIG. 2 is a timing chart showing operation timings of components during printing operation of the image forming apparatus shown in FIG. 1.

Also, the photosensitive drum 2 and the offset roller 7 are driven independently by a motor M1 and a second motor M2 which are rotated under control of motor drivers 111 and 112, respectively. With reference to a timing chart shown in FIG. 2, explanation will now be made of the operation of the image forming apparatus according to the present invention during normal printing. Operation timings are controlled by the CPU 101. The CPU 101 is further connected with a ROM 150 storing programs and the like, a RAM storing detection results and the like, etc.

While the apparatus is on standby after the main power source of the image forming apparatus 1 shown in FIG. 1 is turned on and warming-up is completed, the offset roller heater 7*a* is always under normal temperature control, and the polygon motor of a laser optical system is stopped or rotated at a low speed.

After printing operation is started, the main motor (first motor M1), the offset roller motor (second motor M2), a squeeze motor not shown, a supply pump not shown, and the discharger LED 8 operate, and the polygon motor of the laser optical system starts rotating at a high speed. Note that the main motor is a motor which drives the photosensitive drum 2, the developing rollers 52 (*a, b, c,* and *d*), and a sheet feed-out system. These components are controlled by the CPU 101.

At this time, supply and circulation of a developing liquid are started in the side of the developing unit.

Figure 3:
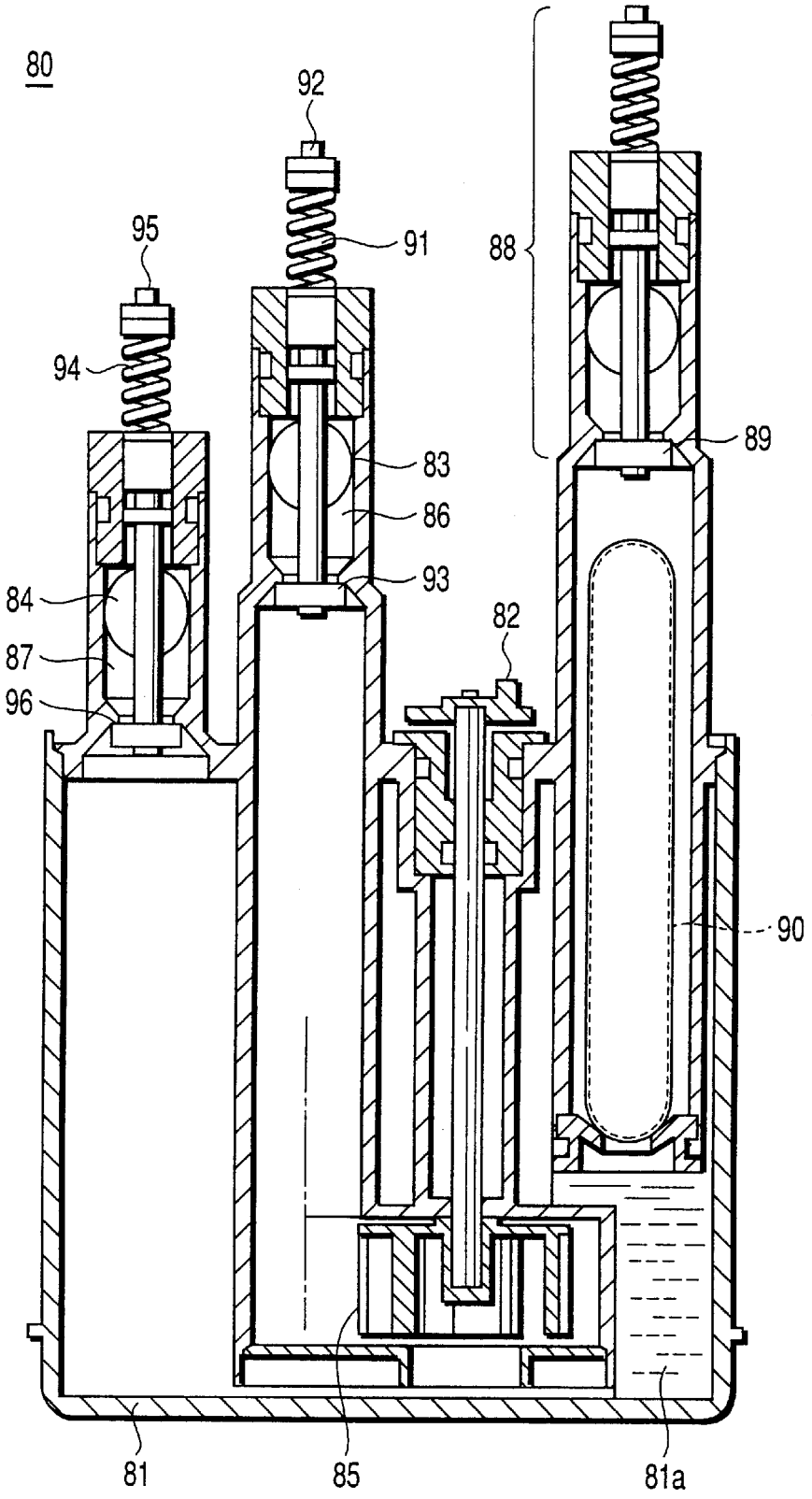
FIG. 3 is a schematic plan view showing a developing liquid supply unit applied to the developing device of the image forming apparatus shown in FIG. 1.
Figure 4:
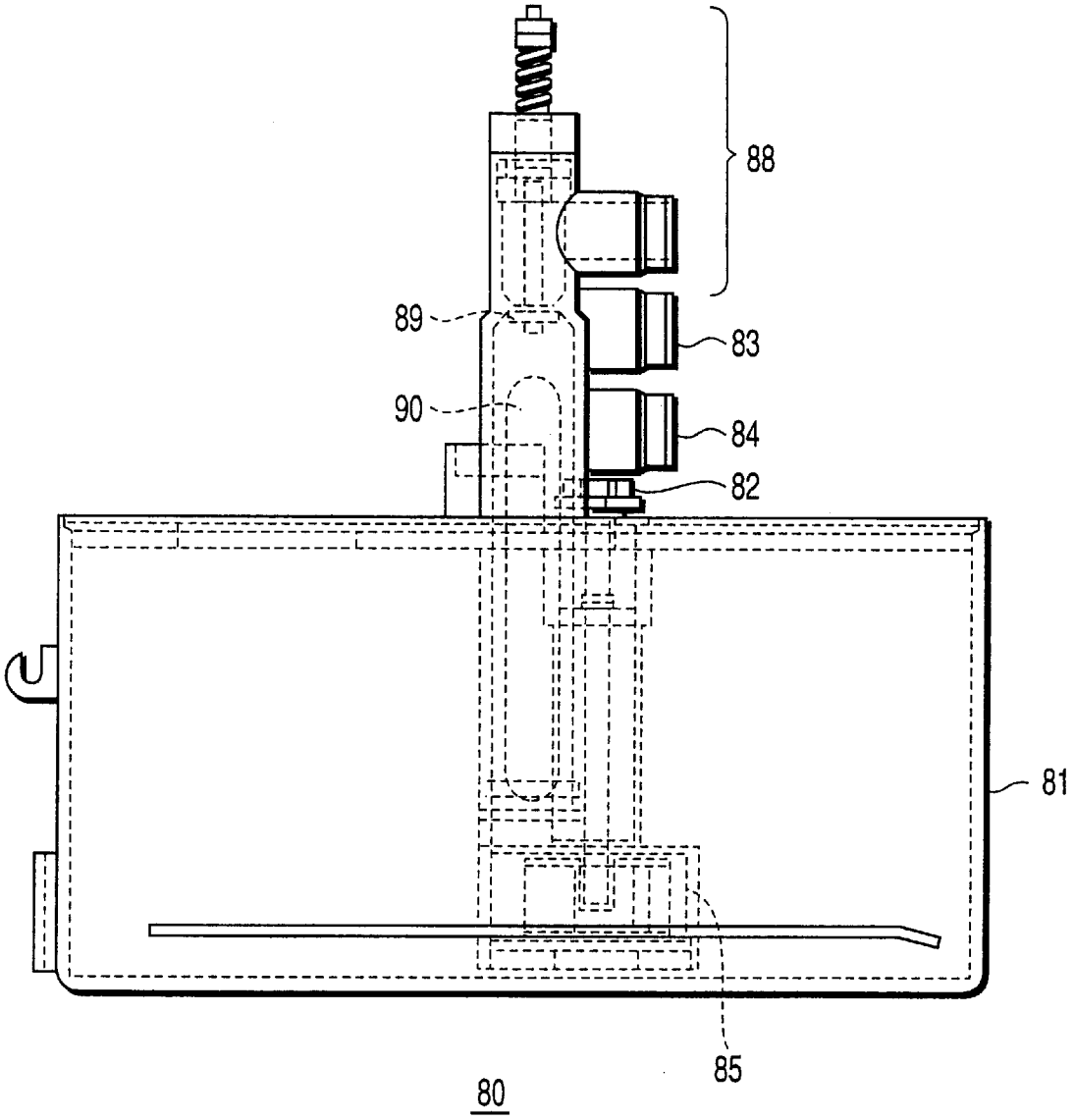
FIG. 4 is a schematic side view showing the developing liquid supply unit shown in FIG. 3.
Figure 5:
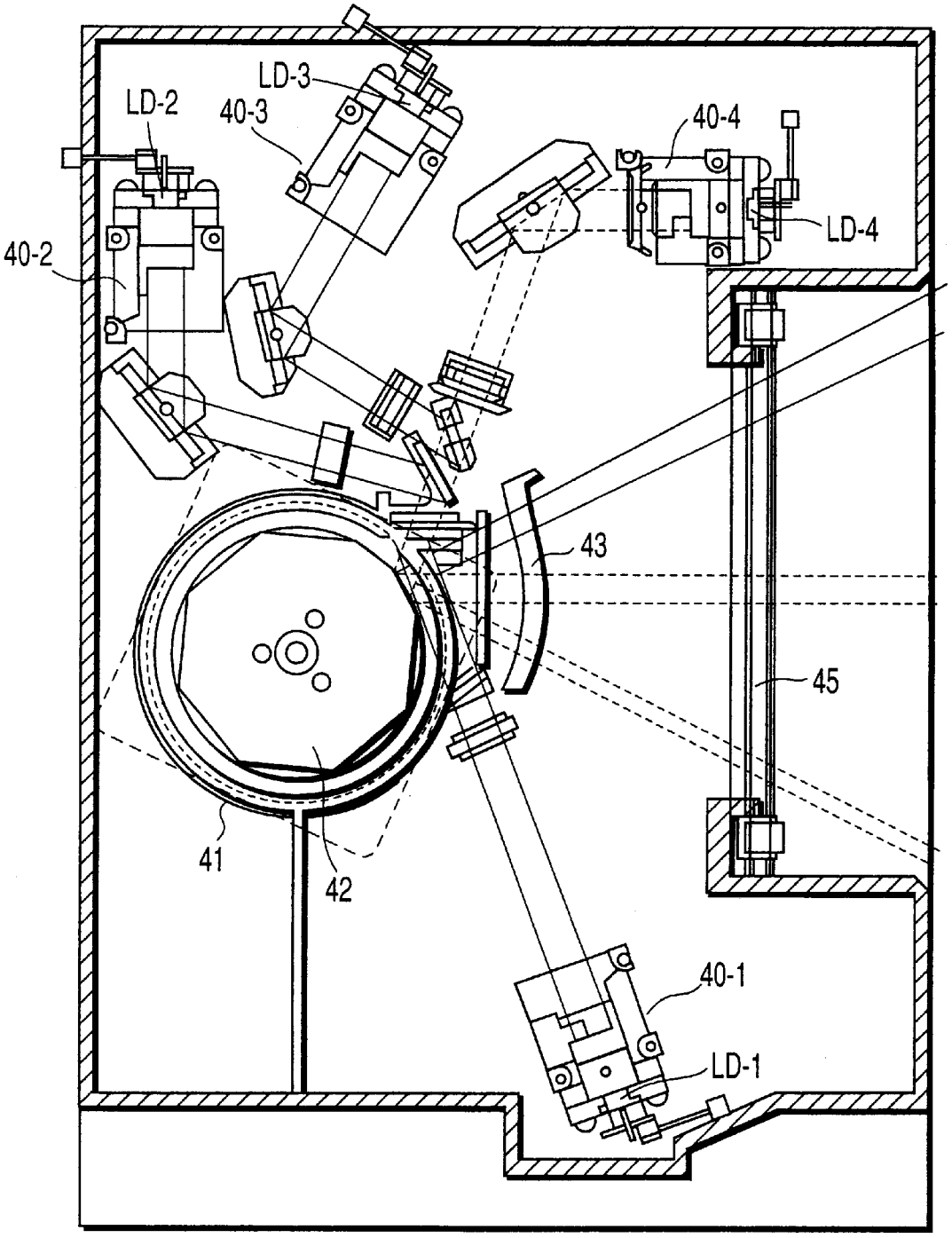
FIG. 5 is a schematic view showing an exposure unit of the image forming apparatus shown in FIG. 1.

FIG. 3 shows a front view of the developing liquid supply unit according to the present invention. FIG. 4 shows a side view thereof.

As shown in FIGS. 3 and 4, the developing liquid supply unit 80 has a container 81 for containing a developing liquid. The unit 80 is also provided with a coupling 82 as a driven member which is driven externally, a discharge section 83 for discharging a developing liquid to the outside, and a receive section 84 for receiving a developing liquid from the outside. Further, the developing liquid supply unit 80 according to the present invention has an impeller 85 as a developing liquid transfer means for stirring the developing liquid contained in the container 81 and for supplying the developing liquid contained in the container, to the developing device (e.g., the inside of a partition wall, including the developing rollers 52(*a, b, c,* and *d*) in FIG. 1) through the discharge section 83, based on a drive force to the driven member. Further, the unit 80 operates to return the developing liquid through the receive section 84 from the developing device 5.

A chamber 86 including the discharge section 83 of the developing liquid supply unit 80, and a chamber 87 including the receive section 84 are respectively provided with valves 93 and 96 which can be moved by a force from the outside. The valves 93 and 96 can be applied with forces from the outside by shafts 92 and 96, respectively. Springs 91 and 94 are respectively provided in areas in the middles of the shafts 92 and 95. Since shafts and springs are thus provided, developing liquids in the chamber 86 including the discharge section 83 and the chamber 87 including the receive section 84 in the developing liquid supply unit 80 of the present invention are shielded from the outside due to the functions of the valves as long as a force is not applied from the outside.

When the developing liquid supply unit 80 is attached to the image forming apparatus 1, the shafts 92 and 95 are applied with a force and pushed down. Therefore, the valves 93 and 96 connected to the shafts are also pushed down and opened. Accordingly, the developing liquid contained in the container 81 can be supplied to the developing device.

Meanwhile, when the developing liquid supply unit 80 is detached from the image forming apparatus, the force from the outside is released. Therefore, the shafts 92 and 95 are lifted upward due to operations of the springs respectively provided for the shafts 92 and 95, and the valves 93 and 96 are closed. The chamber 86 including the discharge section 83 and the chamber 87 including the receive section 84 are shielded from the outside. Accordingly, the developing liquid does not flow out of the container if the developing liquid supply unit 80 is inclined. Of course, the present invention is not limited to this valve mechanism described above, as long as the developing liquid supply unit includes a mechanism as follows. That is, the mechanism is attachable to and detachable from the image forming apparatus, securely maintains a supply/circulation path such that the developing liquid can be supplied and circulated when it is attached, and shields the supply/circulation path when it is detached.

Since the impeller 85 is provided and embedded in the developing liquid contained in the container 81, the developing liquid can be effectively stirred and supplied. In addition, there is an effect of sufficiently stirring the toner components contained in the developing liquid and deposited more or less at the bottom of the container. Accordingly, it is possible to supply always a proper developing liquid to the developing apparatus. To attain this effect sufficiently, the impeller should desirably be provided at the bottom part of the container 81 so that the impeller is buried sufficiently in the developing liquid.

By the developing liquid supply unit of the present invention constructed as described above, replacement of the cartridge tank itself is achieved for the first time. Conventionally, cartridges cannot be replaced, but the developing liquid is supplied by charging a liquid to a container which cannot be detached. Consequently, it is impossible to avoid defects from occurring in images due to long-time use. These conventional problems can be eliminated by the present invention.

Next, electrification chargers 3*a* to 3*d* arranged along the periphery of the photosensitive drum 2 operate and start charging the surface of the photosensitive drum 2.

The photosensitive member used in this case is a drum-like photosensitive member in which aluminium is vapor-deposited on a PET (Polyethylene Terephthalate) sheet and a sheet-like photosensitive member coated with a photosensitive layer is wound around a cylinder. The outer diameter thereof is set to 189 mm. In the aspect of the charging characteristic, the same charging polarity as that of the toner in the liquid developer can be obtained. As the photosensitive layer material, it is possible to use known materials such as ZnO (zinc oxide), CdS (cadmium-sulfer alloy), OPC (organic photosensitive material), α-Si (amorphous silicon), and the like. The photosensitive drum having this structure is rotated at a circumferential speed of 127 mm/s in the above embodiment. The photosensitive drum as described above, in which a sheet-like photosensitive material is wound around a cylinder, provides a merit of easy reproduction at low costs, particularly in case of a photosensitive drum having a large outer diameter like the embodiment of the present invention.

Of course, it is possible to use appropriately a photosensitive member in which a photosensitive layer is formed on a conductive raw tube by directly coating or vapor-depositing a photosensitive material.

Subsequently to the charging of the photosensitive member 2, a bias voltage is applied to the developing rollers 52 (*a, b, c,* and *d*), and the position of the photosensitive drum 2 (the position of the joint portion thereof). Then, writing of electrostatic latent images is started on the surface of the photosensitive drum 2 by irradiating laser beams L.

Next, the laser optical system in the image forming apparatus according to the present invention will now be explained specifically.

As shown in FIG. 1, in the image forming apparatus according to the present invention, a plurality of image forming sections are arranged in an arc-like layout. The image forming sections respectively have imaging points La to Ld of the laser where latent images are formed on the photosensitive member 2. The imaging points La to Ld are arranged in an arc-like layout along the circumference of the photosensitive drum 2.

The unit for exposing the surface of the photosensitive drum 2 will be explained with reference to FIGS. 1 to 5. The exposure unit is comprised of laser diodes LD-1, LD-2, LD-3, and LD-4, cylindrical lenses 40-1, 40-2, 40-3, and 40-4, a polygon mirror 42 as a deflection means, and a polygon mirror motor 41 for driving the polygon mirror 42. A plurality of laser beams are let pass through one set of laser optical lenses as free curved lenses.

The polygon motor 41 is controlled by the CPU 101 through the polygon mirror motor driver 113.

Subsequently, the laser beams L form images on the drum 2 through the mirror 44, 48-2 to 48-4, 46-1 to 46-4, and parallel plate glasses 47-1 to 47-4. That is, the laser beams respectively forms images on the imaging points La to Ld on the photosensitive drum 2.

By thus constructing the structure, the optical system device can be settled as one compact unit. In addition, the present embodiment uses an arc-like photosensitive drum. Therefore, it is possible to prevent occurrence of defective images, such as synchronization blur and meandering of images, which are caused when using a conventional belt-like photosensitive member. Since one single polygon mirror and one set of lenses are used, it is possible to realize an image forming apparatus with high positional accuracy.

After latent images are formed by irradiating laser beams as described above, development is carried out on the photosensitive drum 2.

Figure 6:
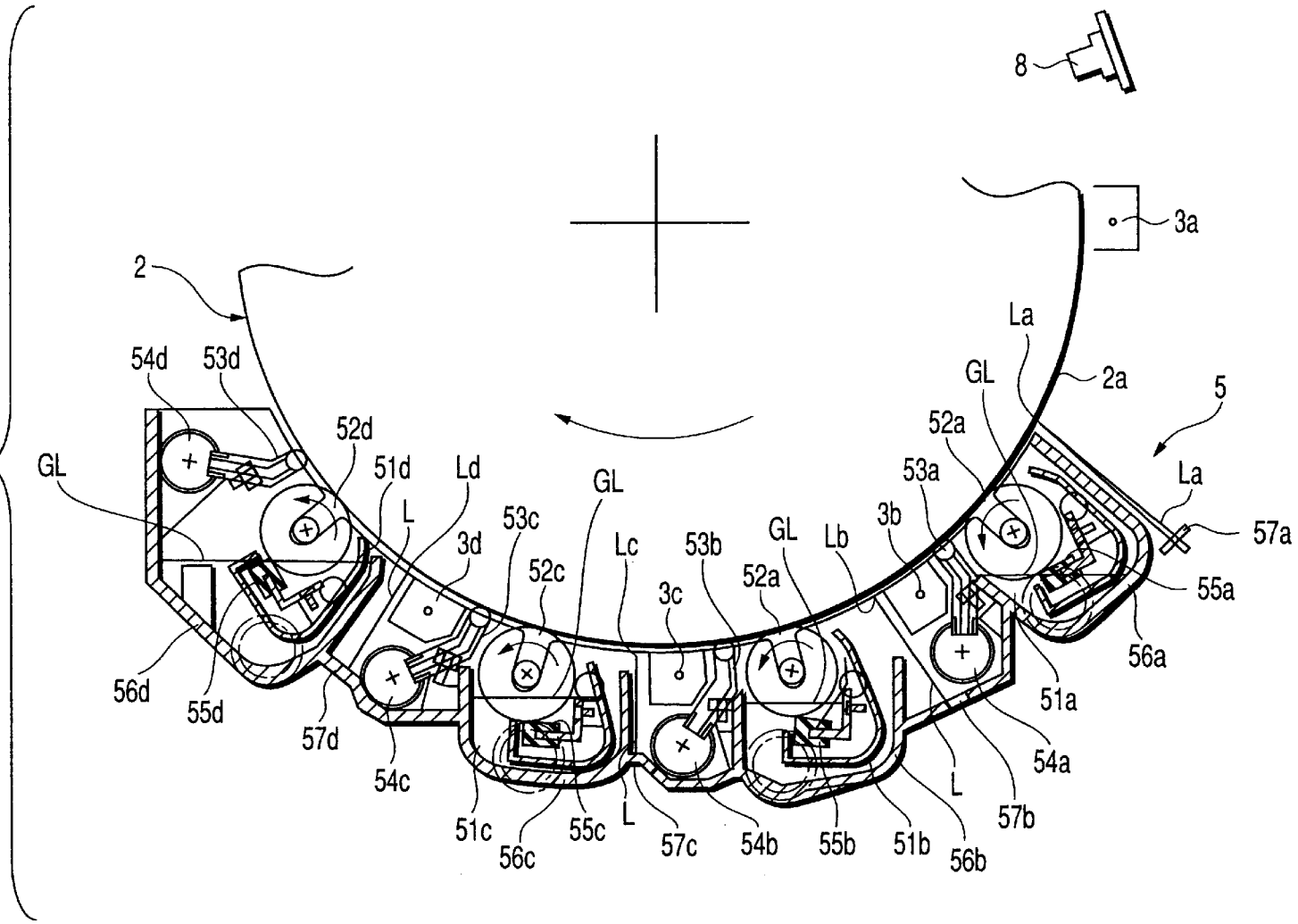
FIG. 6 is a schematic view partially showing the developing device of the image forming apparatus shown in FIG. 1.

In the developing device, a developing liquid is supplied from the developing liquid supply unit. As shown in FIG. 6, the developing rollers 52 (*a, b, c,* and *d*) sufficiently coated with a developing liquid are positioned with a predetermined distance maintained from the surface of the photosensitive drum 2 by guide rollers 58 (*a, b, c,* and *d*). In this embodiment, the diameter of the developing rollers 52 (*a, b, c,* and *d*) and the diameter of the guide rollers 58 (*a, b, c,* and *d*) are respectively set to 21.7 mm and 22.0 mm. The distance between each developing roller 52 (*a, b, c,* and *d*) and the photosensitive drum 2 is set to 150 μm. Each developing roller 52 (*a, b, c,* and *d*) is rotated at a circumferential speed 1.5 times higher than the that of the photosensitive drum 2, in the width direction (in which the moving direction of the surface of the photosensitive drum 2 at the position where each roller is close to the photosensitive drum is equal to the moving direction of the surface of the photosensitive drum 2).

The developing rollers 52 (*a, b, c,* and *d*) used herein can be constructed by a conductive material, and are appropriately applied with a developing bias during development. A fine small gap (about 0.15 mm) is provided between each developing roller 52 (*a, b, c,* and *d*) and the photosensitive drum 2. Therefore, electrified toner grains in the developing solution causes electrophoresis due to the electric field between the photosensitive drum 2 and each developing roller 52 (*a, b, c,* and *d*). The development is hence performed such that the toner grains are pushed against the surface of the latent image forming part of the photosensitive drum 2. The developing rollers 52 (*a, b, c,* and *d*) thus constructed are arranged in an arc-like layout along the circumference of the photosensitive drum 2 with respect to the colors of yellow, cyan, magenta, and black.

FIG. 6 shows a schematic view partially showing the developing device in the image forming apparatus according to the present invention, which uses a drum-like photosensitive member. As shown in FIG. 6, four developing devices 51*a,* 51*b,* 51*c,* and 51*d* are arranged along the periphery of the photosensitive drum 2. In each developing device 51 (*a, b, c,* and *d*), a developing liquid is supplied and collected from one end in the longitudinal direction. In the developing devices, a developing liquid level GL is maintained and exists between the opening partition walls 56*a,* 56*b,* 56*c,* and 56*d* and the lowermost portions of the developing rollers 52*a,* 52*b,* 52*c,* and 52*d,* respectively.

The developing devices 51*a,* 51*b,* 51*c,* and 51*d* are respectively provided with windows 57*a,* 57*b,* 57*c,* and 57*d.* These developing devices 51 (*a, b, c,* and *d*) can be constructed as an integrated unit 5 which combines all these devices.

It is possible to provide an integrated color image forming unit which is compact and replaceable as a whole unit, if an integrated color image forming unit is constructed so as to include at least plural developing rollers, plural means for removing excessive developing liquids on the photosensitive member, plural means for charging the photosensitive member, and plural windows for passing beams from an exposure means for forming electrostatic latent images on the photosensitive member.

Conventionally, a plurality of developing devices are provided independently from each other on one single plane. It is therefore impossible to use one single drum-like photosensitive member. A belt-like photosensitive member is used instead. If an independent photosensitive drum is used for every developing device, a multi-color image can be formed even if developing devices are arranged on one single plane. This case, however, involves many problems, e.g., complication of the structure of the image forming apparatus, etc.

As shown in FIG. 6, by situating the lowermost parts of the developing rollers 52 (*a, b, c,* and *d*) below the developing liquid level GL in the developing devices, a plurality of developing devices can be used for one single drum-like photosensitive member 2.

The developing liquid used in the developing devices 5 (51 (*a, b, c,* and *d*)) is prepared by dispersing toner grains in a carrier liquid. This developing liquid mainly contains a carrier liquid, a coloring agent, resins, and an additive agent.

The carrier liquid should preferably be an insulating liquid having a high resistance and a low viscosity. For example, the carrier liquid may be isoparaffin-based hydrocarbon such as Isopar (commercial name) available from Exon, normal-paraffin-based hydrocarbon such as Norpar (commercial name), and the like.

As the additive agent, it is possible to use an electrification control agent, a dispersing agent, and the like represented by metal soap. Carbon and various color pigments can be used as the coloring agent. Acryl-based resins, styrene-based resins, and the like can be used as the coloring agent. Appropriate materials are selected and used for the toner material.

In the developing device 5 (51 (*a, b, c,* and *d*)) which is supplied with the developing liquid composed by the components described above, cleaning members 55*a,* 55*b,* 55*c,* and 55*d* are provided such that they can be brought into contact with the developing rollers 52*a,* 52*b,* 52*c,* and 52*d,* respectively, as shown in FIGS. 1 and 6.

In the image forming apparatus according to the present invention, electrostatic latent images formed on the photosensitive drum 2 are developed by supplying a liquid developer containing toner and a carrier liquid. Therefore, an excessive liquid developer remains on the surface of the photosensitive drum 2 after development. This excessive liquid developer is removed by squeeze nozzles 53*a,* 53*b,* 53*d,* and 53*d* arranged to be subsequent to the developing rollers 52*a,* 52*b,* 52*c,* and 52*d,* respectively.

The squeeze nozzles 53 (*a, b, c,* and *d*) as means for removing an excessive liquid developer are arranged in an arc-like layout along the circumference of the photosensitive drum 2 behind the developing devices 51 (*a, b, c,* and *d*) of respective colors, respectively. By adopting this structure, the apparatus can be compact, and problems such as mixture of a liquid developer and colors can be prevented. In a prior art example, squeeze rollers 56 and 58 are used to remove an excessive liquid developer on a photosensitive member 20. However, the squeeze nozzles 53 (*a, b, c,* and *d*) according to the embodiment of the present invention shown in FIG. 1 can be installed saving more space.

Figure 7A:
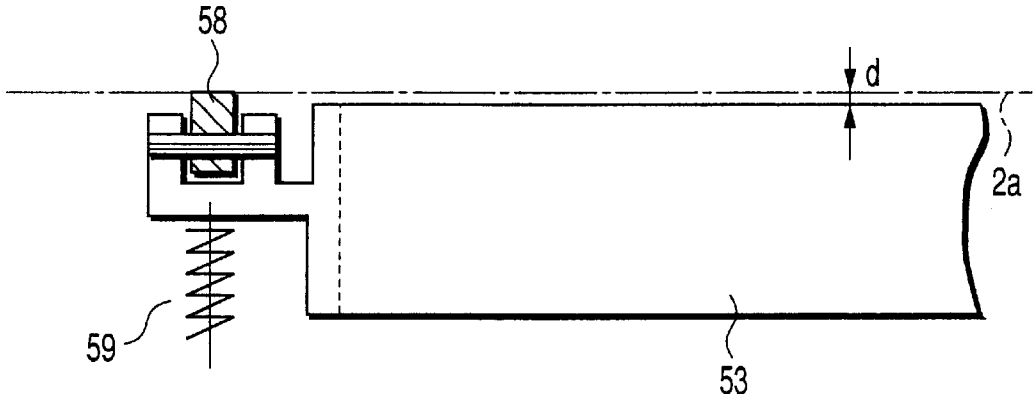
FIGS. 7A, 7B, and 7C are schematic views for explaining a squeeze nozzle integrally incorporated in the developing device of the image forming apparatus shown in FIG. 1.
Figure 7B:
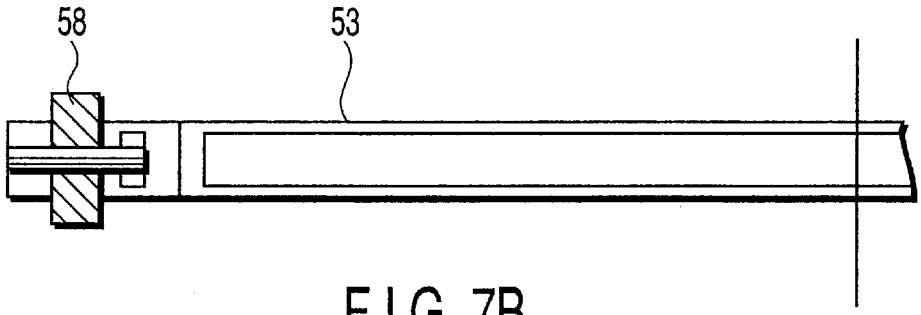
Figure 7C:
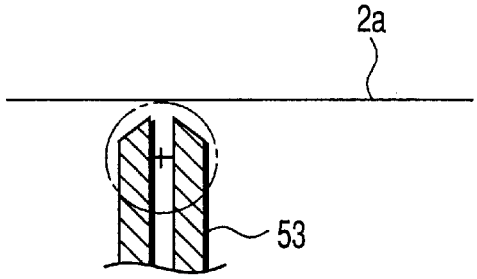

FIGS. 7A, 7B, and 7C show schematic views of layout of the squeeze nozzles 53 (*a, b, c,* and *d*) and the photosensitive drum 2 shown in FIG. 1.

As shown in FIG. 7A, each squeeze nozzle 53 (*a, b, c,* and *d*) is arranged apart from the photosensitive member 2, with its top end oriented to the photosensitive member 2. A guide roller 58 provided therebetween maintains a predetermined distance between the top end of each nozzle 53 (*a, b, c,* and *d*) and the photosensitive member 2.

A spring 59 is provided below each nozzle 53.

The distance d between each squeeze nozzle 53 and the photosensitive member 2 should preferably be set to 100 to 300 $\mu$m. If the distance between each nozzle 53 and the photosensitive member 2 is smaller than 100 $\mu$m, the toner image developed on the latent image may be suctioned. On the other hand, if the distance exceeds 300 $\mu$m, it is difficult to suction sufficiently the excessive liquid developer on the photosensitive member 2. However, the distance between each nozzle 53 and the photosensitive member 2 can be set to 300 $\mu$m or more, by raising the suction force of each nozzle.

The squeeze nozzles 53 can be effectively used for removing the excessive developing liquid on the photosensitive member 2 before transfer. If each nozzle is located at a position after development and before transfer, a much better diaphragm effect can be attained so that the carrier liquid for transfer can be reduced.

FIG. 7B shows a relationship between a nozzle 53 and a guide roller 58 viewed from the side of the photosensitive member 2. FIG. 7C is a side view thereof.

Through the steps as described above, a first toner image is formed on the photosensitive drum 2, and an excessive developing liquid is removed by a squeeze nozzle 53. Thereafter, the photosensitive drum 2 is charged again by the electrification charger 3*b* shown in FIG. 1. Steps of exposure, development, and squeeze are repeated. After completion of the last development and squeeze, the laser light source is turned OFF as shown in the timing chart of FIG. 2. Subsequently, the developing liquid supply pumps, electrification charges, and the developing bias are stopped.

As shown in FIG. 1, a plurality of electrification chargers 3*a* to 3*d* for charging the photosensitive drum 2 are also arranged in an arc-like layout around the photosensitive drum 2 before the latent image forming means for the colors, respectively, in the image forming apparatus 1 according to the present invention. As a result of this, the apparatus can be compact, and problems of mixture of liquid toner and colors can be prevented by proper recharging.

As described above, a color image is formed on the photosensitive member by letting it pass through a plurality of image forming sections. Thereafter, the image area moves to a transfer section as the photosensitive member rotates. In this transfer section, the color image on the photosensitive member is transferred to the offset roller 7 by the effects of heat and pressure. Subsequently, the image is further transferred to a recording paper P as a transfer-target member conveyed at a proper timing, between the offset roller 7 and the backup roller 9.

As the offset roller 7, it is possible to use a roller in which a conductive silicon rubber layer is formed on a mandrel. The offset roller 7 internally holds a lamp 7*a* as a heat source and is maintained at a predetermined temperature of 50 to 150° C. by a thermistor not shown. The offset roller 7 is pressed against the photosensitive drum 2 under a pressure of about 500 N as a total load. To improve the transfer characteristic, a predetermined bias voltage may be applied. On the other hand, the backup roller 9 has a silicon rubber layer and is pressed against the offset roller 7 by a force of about 300 N as a total load. The image is transferred to the recording paper P by these rollers.

Subsequent to the transfer of the image to the recording paper, toner remaining after the transfer on the offset roller is cleaned.

Figure 8:
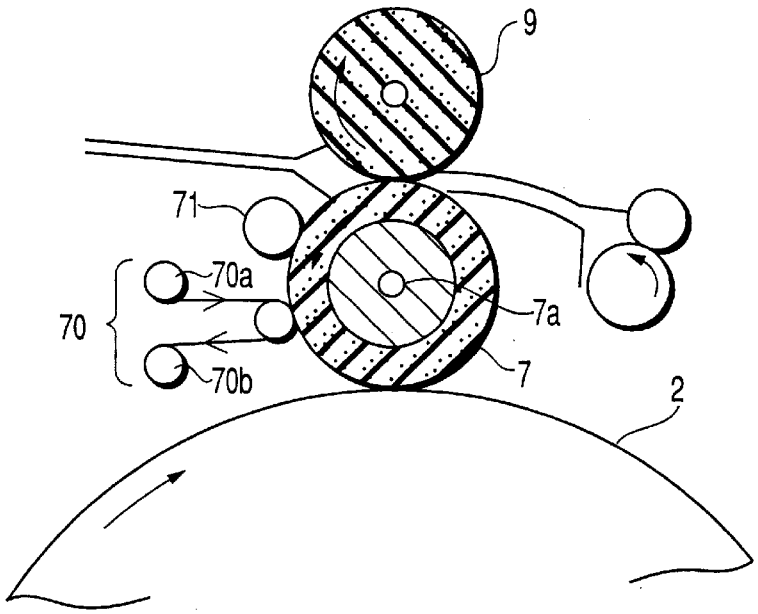
FIG. 8 is a schematic view showing an offset roller and a cleaning mechanism thereof which are applied to the image forming apparatus shown in FIG. 1.

FIG. 8 shows a schematic view of the periphery including a cleaning member of the offset roller. As shown in FIG. 8, a web cleaning mechanism 70 is attached in contact with the offset roller 7. The cleaning roller 71 is provided apart from the offset roller 7 but can be brought into contact therewith.

When jamming (of papers) occurs and the offset roller 7 is abnormally stained with toner, the cleaning roller 71 which is normally apart from the offset roller 7 is pressed against the offset roller 7 by a total load of about 100 N, due to a mechanism of a solenoid or the like not shown. The cleaning roller 71 then rotates as a slave together with the offset roller 7. As a result of this, toner on the offset roller 7 is subjected to transfer-cleaning by the cleaning roller 71. When the cleaning roller 71 was rotated as a slave for one turn of the offset roller 7 under the condition described above, almost all of the toner could be cleaned perfectly from the offset roller 7. Thus, it has been confirmed that the offset roller 7 can be cleaned by thus rotating the offset roller 7 by one turn or more with the cleaning roller 71 kept in contact with the offset roller 7. As the cleaning roller 71, it was possible to use a metal roller made of SUS (stainless steel) or a roller with felt wound around a mandrel. In normal printing operation except for jamming, the remaining toner is of a very small amount and can sufficiently be cleaned by the web cleaning mechanism 70 used in an electrophotographic copying machine or the like.

As described above, a removal means for removing an excessive developing liquid on the photosensitive member by means of a nozzle is provided in the image forming apparatus according to the present invention. The removing means can be constructed by a suction means for suctioning air and a pipe member. In the middle of the pipe, there is provided a filter mechanism for separating a liquid developer from the suctioned air.

Figure 9:
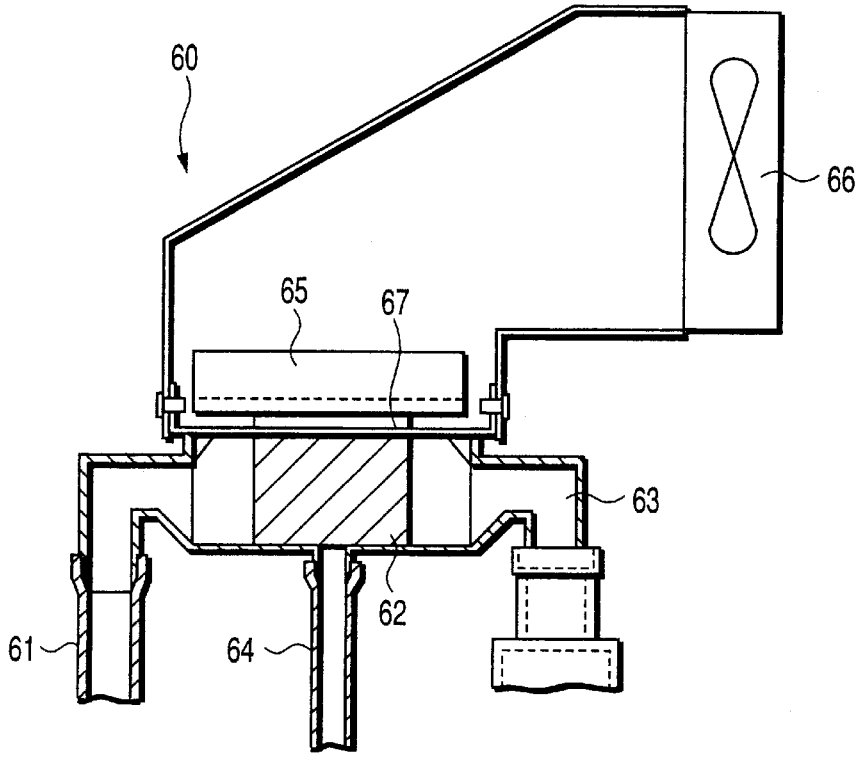
FIG. 9 is a schematic view showing a filter part used for the image forming apparatus shown in FIG. 1.

FIG. 9 shows a schematic view of an example of the periphery of the filter mechanism 60. As shown in FIG. 9, the liquid developer removed from the photosensitive member 2 is introduced from the air inlet port 61, passes through the filter member 62, and is discharged from the air outlet port 63. The liquid developer trapped by the filter member 62 flows out through the liquid discharge port 64 and is thereafter collected by the developing liquid supply unit shown in FIGS. 3 and 4. This will be described later.

In FIG. 9, the fan 66 is used to cool the fin 65 made of aluminium. A porous metal material, such as stainless steel, aluminium, copper, and the like, is desirable for the filter member 62. In this case, the number of cells is set to 5 to 50 cells per inch. To liquidize a solvent (carrier liquid) gas or to trap a mist of carrier liquid, it is desirable to provide a cooling means 67 for cooling the porous metal material to a temperature of 5 to 20° C. In this case, a Peltier element can be used as the cooling means 67.

When a porous metal material was used as the filter member, the ability to remove the solvent could be remarkably improved, and the lifetime of the filter could be more extended than the in case of using active carbon.

In the image forming apparatus according to the present invention, the excessive developer liquid suctioned and removed from the photosensitive member with use of a removing means such as a nozzle or the like can be collected into the developing liquid supply unit of the image forming apparatus, which is provided to be attachable and detachable. This mechanism will now be explained with reference to FIGS. 3 and 4.

The developing liquid removed from the photosensitive member 2 is returned to the container inside 81a through a developing liquid returning means 88 shown in the figure. In this case, the returning means 88 may have a valve 89 which is opened/closed by a solenoid or so. As shown in FIG. 4, the chamber including the float 90 is provided as a reserve flow-in part in front of the container inside 81*a*. By opening the valve 89, the developing liquid firstly flows into the chamber including the float 90. When a predetermined amount of developing liquid is collected in this chamber, the float 90 floats up so that the bottom part of this chamber and the container inside communicate with each other. The developing liquid then returns to the container inside 81*a*. As the developing liquid flows out into the container inside, the float sinks and this chamber is separated from the container inside again.

By using this kind of developing liquid returning means, the developing liquid can be returned to the developing liquid supply unit without transmitting an external pressure. In a conventional image forming apparatus, the developing liquid is not collected into a developing liquid supply unit but is collected into a container which is optionally provided. Therefore, the developing liquid in the developing liquid supply unit decreases rapidly. This causes a number of problems, such as deterioration of the image quality and the like. However, according to the present invention, a long time use is realized with maintaining excellent image quality.

Figure 10:
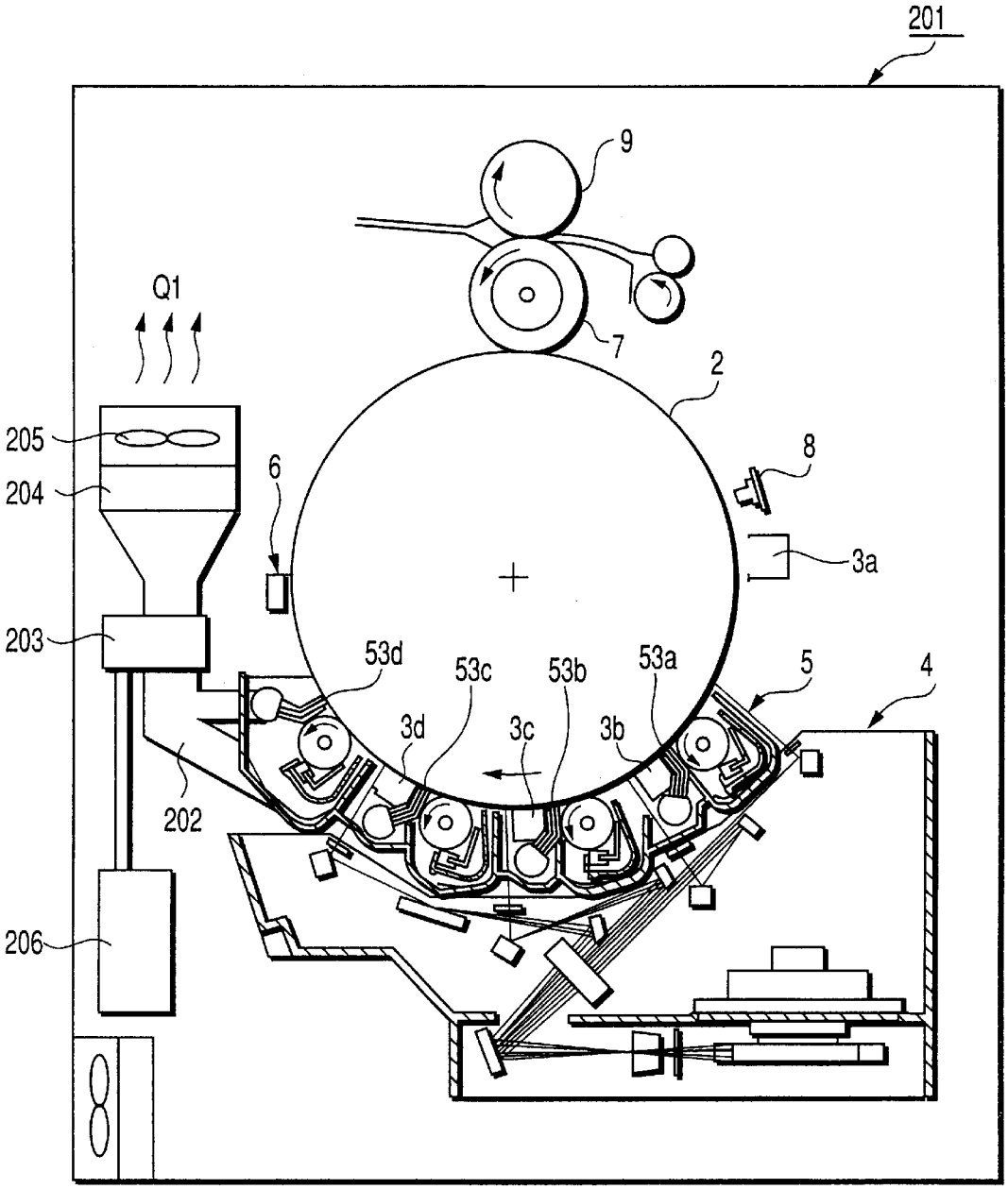
FIG. 10 is a schematic view for explaining another embodiment of the image forming apparatus shown in FIG. 1.
Figure 11:
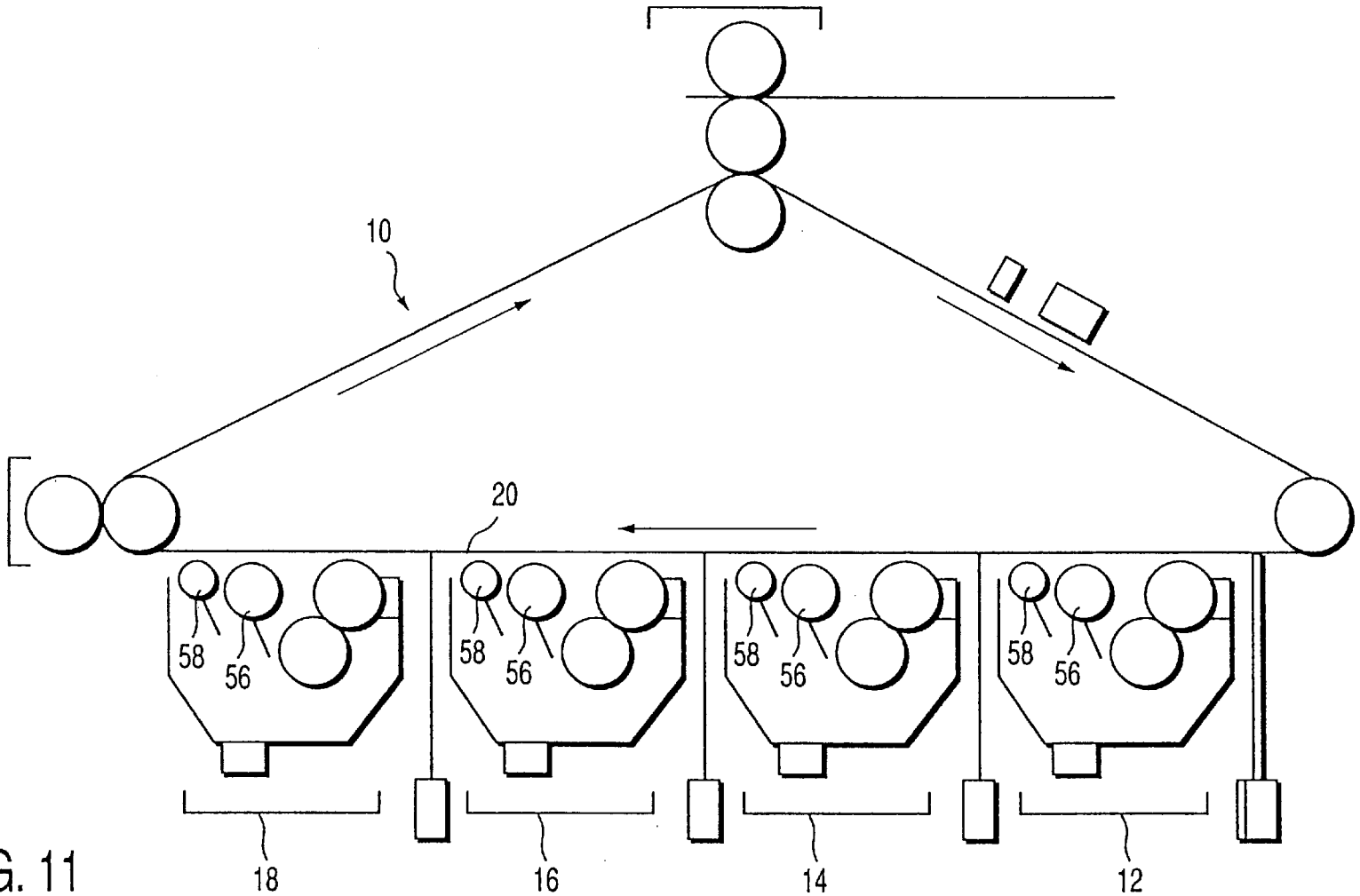
FIG. 11 PRIOR ART
FIG. 11 is a schematic view for explaining an example of an image forming apparatus according to a known liquid developing method.

FIG. 10 schematically shows another example of the image forming apparatus of the present invention.

As shown in FIG. 10, in the image forming apparatus 201 according to the present invention, a plurality of squeeze nozzles 53 (*a, b, c,* and *d*) for removing an excessive developing liquid remaining on a photosensitive drum are provided in an arc-like layout along the photosensitive drum 2. The developing liquid is suctioned as a mist or vapor together with air by these squeeze nozzles 53 (*a, b, c,* and *d*). The air containing the developing liquid passes through a solvent liquidizing device 203 for collecting the developing liquid, as shown in FIG. 10. Thereafter, the air passes through a filter 204 made of active carbon or a catalyst. The air is discharged into the inside of the apparatus at a discharge gas capacity of Q1 by a fan 205 and is circulated in the apparatus. By this circulation inside the apparatus, dust is prevented from being suctioned from the outside of the apparatus. The collected developing liquid is collected into the solvent collection tank 206.

When the gas exhausted from the fan 205 was actually discharged directly to the outside, the gas capacity Q1 was 2 $m^3$/min. The same amount of air flowed in from the outside, so the filter 204 was clogged and the developing liquid was soiled with dust disadvantageously.

When the exhausted gas was discharged into the apparatus and was circulated inside the apparatus, clogging of the filter 204 and the soiling of the developing liquid with dust were not caused.

As explained above, the image forming apparatus according to the present invention has a removing device for removing an excessive developing liquid by means of a nozzle when an image is formed according to a liquid developing method using a developing liquid with toner dispersed in a solvent. The removing device is constructed by, for example, a suction mechanism for suctioning air and a pipe member.

A filter member for separating a developing liquid from air suctioned by the nozzle is provided in the middle of the pipe member. The air after developing liquid is separated is circulated inside the apparatus. Meanwhile, the separated developing liquid is returned to the container in the developing liquid supply unit.

According to this structure, it is possible to prevent rapid decrease of the developing liquid, by collecting an excessive developing liquid with use of the developing liquid returning mechanism.

In addition, the returned developing liquid is prevented from mixture with undesired components such as dust or so. Therefore, excellent images can be attained for a long time period.

Further, each of the developing device and the developing liquid returning mechanism is integrated as a unit. Accordingly, operationality in charging of the developing liquid and maintenance can be improved, and the inside of the apparatus and users are not soiled undesirably.

The developing device according to the present invention is easily applicable to many image forming apparatuses such as an monochrome or color electrophotographic apparatus of a liquid developing method, an electrophotographic apparatus of a multi-path liquid developing method, and the like, which are compatible with recording papers of various sizes. In addition, the developing device is applicable to image forming apparatuses of various types, regardless of the size of the photosensitive member thereof.

As has been explained above, the image forming apparatus according to the present invention has a removing device for removing an excessive developing liquid by a nozzle after development according the liquid developing method. The air and the developing liquid suctioned by the nozzle are separated. The separated developing liquid is returned to the developing liquid supply unit by the developing liquid returning mechanism, and the air after separation of the developing liquid is circulated in the apparatus. Owing to collection of the developing liquid, the developing liquid is prevented from decreasing rapidly. The returned developing liquid is prevented from being mixed with undesirable components such as dust and the like. Accordingly, excellent images can be attained for a long time period.

In particular, each of the developing device, the developing liquid supply mechanism, and the developing liquid returning mechanism (circulation mechanism) is integrated as a unit. Therefore, they can be easily attached/detached to charge the developing liquid or make maintenance services. In addition, it is possible to prevent defective images from being caused by mixture of paper dust or lumps of toner.

Since openings are shielded by valves, the developing liquid in the container does not flow out even if the developing liquid supply unit is inclined when the developing liquid supply unit is detached.

Further, since the impeller in the developing liquid supply unit is arranged and buried in a developing liquid contained in the container, the toner in the developing liquid can be steadily stirred. In addition, the impeller can sufficiently stir toner which is more or less deposited on the bottom of the container. As a result of this, it is possible to prevent the image density from changing undesirably, and stable images can be provided for a long time period.

Further, by adding the developing liquid returning mechanism to the developing liquid supply mechanism, only the developing liquid can be easily returned to the developing liquid supply mechanism from the excessive developing liquid. The developing liquid in the developing liquid supply unit is prevented from decreasing rapidly, so the image quality is prevented from deteriorating due to rapid decrease of the developing liquid. Accordingly, excellent images can be prevented for a long time period.

Further, in the image forming apparatus according to the present invention, the exposure system is constructed as one unit. It is therefore possible to prevent occurrence of image defects such as synchronization blur, meandering, and the like. Since one single polygon mirror and one set of lenses are used, it is possible to obtain a color image without color shifts caused by images of respective colors which are offset from each other.

In addition, the lowermost part of the developing roller in each developing device is positioned below the liquid level of the developing liquid in the housing. Therefore, in case where a plurality of developing devices of a liquid developing method are arranged along the outer circumferential surface of the drum-like photosensitive member, uniform developing conditions can be provided so the size of the entire apparatus can be decreased.

Since the charging devices for electrically charging the photosensitive member are respectively integrated into developing units for the respective colors, the size of the apparatus can be decreased and mixture of toner can be prevented by proper re-charging.

Further, squeeze nozzles for collecting an excessive developing liquid are arranged to be integral with the developing units of the colors, respectively. Therefore, the size of each developing device can be decreased, and mixture of the developing liquid of each color can be prevented.

Further, in each developing unit of the developing device, the squeeze nozzle is faced to the photosensitive layer with a predetermined distance maintained therefrom. The toner which sticks to the latent image is prevented, and an excessive developing liquid is prevented from remaining on the photosensitive layer.

To liquidize a solvent (carrier liquid) gas or to catch a mist of carrier liquid, a cooling device for cooling the porous metal material as a filter member to a temperature of about 5 to 20° C. is provided, so that the solvent can be steadily collected. As a result, the lifetime of the filter is elongated. The running cost is reduced accordingly.

Further, the developing device is constructed by developing units for respectively forming images of yellow (Y), magenta (M), cyan (C), and black (B), and squeeze nozzles for respectively collecting the developing liquids in the developing units. The developing units and the squeeze nozzles are integrated respectively. Therefore, the size of the entire apparatus can be decreased. In charging of the developing liquid and maintenance, each unit or the entire developing device can be replaced, so that the operationality can be improved.

Further, a cleaning roller, in which felt or the like is wound around a metal roller made of stainless steel or a mandrel, is rotated in contact with an offset roller used for transfer, only when a paper jams and a large amount of toner sticks to the outer circumferential surface of the offset roller. It is therefore possible to remove toner sticking to the outer circumferential surface of the offset roller.

Further, air and a developing liquid are separated from the developing liquid collected by the squeeze nozzle of each developing unit, and the air is circulated inside the apparatus. It is therefore possible to prevent occurrence of clogging of the filter due to the outer air and to prevent mixture of dust and the like into the developing liquid. As a result, stable images can be provided for a long time period.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing liquid supply unit which has a casing for containing a developing liquid and is detachably attached to an image forming apparatus, comprising:

a driven member for receiving a drive force from outside;

a discharging section for discharging the developing liquid from the casing to the outside;

a receiving section for receiving the developing liquid from the outside into the casing; and a developing liquid transfer mechanism for supplying the developing liquid in the casing, to a developing device in the image forming apparatus, through the discharging section, based on the drive force to the driven section, and for further returning the developing liquid from the developing device into the casing through the receiving section, in a situation that the developing liquid transfer mechanism is attached to the image forming apparatus.

2. A unit according to claim 1, further comprising a prevention valve positioned inside or outside the casing, for preventing flow-out of the developing liquid, the prevention valve being opened and able to transfer the developing liquid only when a force is applied from outside.

3. An image forming apparatus according to claim 1, wherein the developing liquid transfer mechanism includes an impeller provided in the developing liquid contained in the casing, and the impeller rotates based on the drive force to the driven member, thereby to stir the developing liquid in the casing and to supply the developing liquid in the casing, to the developing device in the image forming apparatus, through the discharging section.

4. An image forming apparatus comprising:

a latent image forming mechanism for forming an electrostatic latent image on a photosensitive member;

a developing device for supplying a developing liquid containing at least toner and a carrier liquid, to the photosensitive member on which the latent image is formed, thereby to develop the latent image;

a removing device for removing an excessive portion of the developing liquid supplied by the developing device, the excessive portion of the developing liquid remaining on the photosensitive member after development;

a returning mechanism for returning the excessive portion of the developing liquid, which is removed by the removing device, into a casing of a developing liquid supply unit for supplying the developing liquid to the developing device; and a reserve flow-in section which has a float and is provided in front of a developing liquid container section in the casing of the developing liquid supply unit, thereby to return the developing liquid to the reserve flow-in section when the valve is opened.

5. An apparatus according to claim 4, wherein the returning mechanism has a valve which is opened/closed by a solenoid.

6. An image forming apparatus according to claim 4, wherein when a predetermined amount of the developing liquid flows in, the float of the reserve flow-in section floats up, so that the developing liquid flows out from a bottom part of the reserve flow-in section into the developing liquid container section in the casing, and the float accordingly sinks to separate the developing liquid container section in the casing and the reserve flow-in section from each other.

7. An image forming apparatus comprising:

a latent image forming mechanism for forming an electrostatic latent image on a photosensitive member;

a developing device for supplying a developing liquid containing at least toner and a carrier liquid, to the photosensitive member on which the latent image is formed by the latent image forming mechanism, thereby to develop the latent image; and a removing device for removing an excessive portion of the developing liquid supplied to the photosensitive member by the developing device, the excessive portion of the developing liquid being on the photosensitive member, wherein the removing device includes a nozzle having a top end provided near the surface of the photosensitive member, and having a through-hole, a suction device for suctioning the developing liquid through the through-hole of the nozzle, and a positioning mechanism for setting a predetermined distance between the top end of the nozzle and the photosensitive member.

8. An apparatus according to claim 7, wherein the positioning mechanism is a roller member kept in contact with the surface of the photosensitive member.

9. An image forming apparatus comprising:

a latent image forming mechanism for forming an electrostatic latent image on a photosensitive member;

a developing device for supplying a developing liquid containing at least toner and a carrier liquid, to the photosensitive member on which the latent image is formed by the latent image forming mechanism, thereby to develop the latent image; and a removing device for removing an excessive portion of the developing liquid supplied to the photosensitive member by the developing device, the excessive portion of the developing liquid being on the photosensitive member, wherein the removing device includes a suction device for suctioning air, a pipe member for connecting the suction device with the suction nozzle near the photosensitive member, and a filter member provided in a middle of the pipe member, for separating the carrier liquid from the air suctioned.

10. An apparatus according to claim 9, wherein the filter member is made of a porous metal material.

11. An apparatus according to claim 10, further comprising a cooling mechanism for cooling the filter member.

12. An apparatus according to claim 11, wherein the cooling mechanism is a Peltier element.

13. An image forming apparatus comprising:

a latent image forming mechanism for forming an electrostatic latent image on a photosensitive member;

a developing device for developing the electrostatic latent image by supplying a developing liquid containing at least toner and a carrier liquid, to the photosensitive member on which the electrostatic latent image is formed by the latent image forming mechanism, thereby to form a toner image;

an offset roller provided in contact with the photosensitive member and rotated in synchronization with rotation of the photosensitive member, so that the toner image formed by the developing device is transferred onto the offset roller; and a cleaning mechanism for removing the toner from the offset roller, wherein during cleaning, the offset roller is rotated by one turn or more in contact with the cleaning mechanism.

14. An image forming apparatus comprising:

a latent image forming mechanism for forming an electrostatic latent image on a photosensitive member;

a developing device for supplying a developing liquid containing at least toner and a carrier liquid, to the photosensitive member on which the latent image is formed by the latent image forming mechanism, thereby to develop the electrostatic latent image;

a removing device for removing an excessive portion of the developing liquid supplied by the developing device, the excessive portion of the developing liquid remaining on the photosensitive member; and a developing liquid collecting mechanism connected with the developing liquid removing device, for collecting the developing liquid by suctioning the liquid, wherein an exhaust gas generated by the developing liquid collecting mechanism is circulated inside the image forming apparatus.

* * * * *